US009911264B2

(12) United States Patent
Eun

(10) Patent No.: US 9,911,264 B2
(45) Date of Patent: Mar. 6, 2018

(54) COIN COUNTING APPARATUS

(71) Applicant: Nam Pyo Eun, Gwangju (KR)

(72) Inventor: Nam Pyo Eun, Gwangju (KR)

( * ) Notice: Subject to any disclaimer, the term of this patent is extended or adjusted under 35 U.S.C. 154(b) by 0 days.

(21) Appl. No.: 15/328,910

(22) PCT Filed: Jul. 27, 2015

(86) PCT No.: PCT/KR2015/007769

§ 371 (c)(1),
(2) Date: Jan. 25, 2017

(87) PCT Pub. No.: WO2016/018011

PCT Pub. Date: Feb. 4, 2016

(65) Prior Publication Data

US 2017/0228955 A1 Aug. 10, 2017

(30) Foreign Application Priority Data

Jul. 28, 2014 (KR) ..... 10-2014-0095856

(51) Int. Cl.

| | |
|---|---|
| ***G07D 3/00*** | (2006.01) |
| ***G07D 3/16*** | (2006.01) |
| ***G07D 5/00*** | (2006.01) |
| ***G07D 1/00*** | (2006.01) |
| ***G07D 5/02*** | (2006.01) |
| ***G07D 9/04*** | (2006.01) |

(52) U.S. Cl.

CPC ..... *G07D 3/16* (2013.01); *G07D 1/00* (2013.01); *G07D 5/00* (2013.01); *G07D 5/02* (2013.01); *G07D 9/04* (2013.01)

(58) Field of Classification Search

CPC .. G07D 1/00; G07D 1/02; G07D 1/04; G07D 5/02; G07D 9/008; G07D 9/04

See application file for complete search history.

(56) References Cited

FOREIGN PATENT DOCUMENTS

| | | | |
|---|---|---|---|
| EP | 2146330 A2 | 1/2010 | |
| JP | 07-082560 B2 * | 9/1995 | ..... G07D 5/02 |
| JP | 07-082560 B2 | 9/1995 | |

(Continued)

OTHER PUBLICATIONS

International Search Report dated Nov. 20, 2015 in related International Application No. PCT/KR2015/007769, (5 Pages).

(Continued)

*Primary Examiner* — Mark J Beauchaine
(74) *Attorney, Agent, or Firm* — Eric L. Lane; Green Patent Law

(57) ABSTRACT

The present invention relates to a coin counting apparatus including: a frame in which an accommodation part is formed and a coin transfer channel connected to an outlet provided at a partition forming the accommodation part; a rotating transfer plate rotatably mounted in the accommodation part and including coin-accommodation grooves on a top surface thereof to transfer a coin; a coin-discharging roller unit configured to push the coin toward the outlet using rotational power of the coin to pass the coin through a counter sensing unit at a predetermined speed; and a coin detection unit including a light irradiation unit configured to emit a plurality of beams toward the coin transfer channel and an optical detection unit configured to detect beams reflected by coins to count the coins.

2 Claims, 4 Drawing Sheets

(56) References Cited

FOREIGN PATENT DOCUMENTS

| | | | | |
|---|---|---|---|---|
| JP | 2003-168143 | A | 6/2003 | |
| JP | 2005-174243 | A | 6/2005 | |
| KR | 10-0663636 | B1 * | 1/2007 | ..... G07D 9/04 |
| KR | 10-0663636 | B1 | 1/2007 | |
| KR | 10-2007-0106208 | A | 11/2007 | |
| KR | 10-2008-0102511 | A | 11/2008 | |
| KR | 10-0910963 | B1 | 7/2009 | |

OTHER PUBLICATIONS

English translation of International Search Report dated Nov. 20, 2015 in related International Application No. PCT/KR2015/007769, (6 Pages).

Written Opinion dated Nov. 20, 2015 in related International Application No. PCT/KR2015/007769, (7 Pages).

* cited by examiner

COIN COUNTING APPARATUS

TECHNICAL FIELD

The present invention relates to a coin counting apparatus, and more particularly, to a coin counting apparatus in which detection reliability of coins discharged through a coin transfer channel is improved while sorting the coins to accurately count the discharged coins.

BACKGROUND ART

In general, contactless cards, coupons, banknotes, coins, and the like are used as payment methods for public transportation systems. When using coins among the payment methods, since various kinds of coins are used, there is much difficulty in counting coins.

Particularly when paying transportation expenses with coins, it is not easy to determine whether a paid transportation cost is a correct fare, and furthermore, it functions as a factor that increases a risk of an accident caused by a driver.

A coin sorting apparatus is disclosed in Korean Patent Laid-Open Publication No. 2008-0102511. The coin sorting apparatus includes a sorting housing in which an accommodation part in a circular shape is formed and coin grooves are perforated in a bottom surface thereof for each size of coin along an inner wall of the accommodation part, and a segregating rotating plate rotatably mounted on the accommodation part and configured to transfer coins introduced into the accommodation part along the inner wall of the accommodation part to discharge the coins through the coin grooves.

In addition, a coin counting apparatus is disclosed in Korean Patent Laid-Open Publication No. 2007-0106208. The disclosed coin counting apparatus includes a rotating plate configured to discharge coins using centrifugal force, a high speed transfer roller configured to discharge the coins again to transfer the discharged coins at a high speed using rotational power, and a transfer channel configured to guide the discharged coins toward a counter sensing unit which is known, wherein a curved part is provided at a front end of the transfer channel, and a shock absorber is provided on the curved part to absorb a shock of the coins and transfer the coins along one sidewall of the transfer channel when the coins discharged from the high speed transfer roller are introduced into the curved part.

Furthermore, a high speed coin counting apparatus is disclosed in Korean Patent Registration No. 0663636, and a counting apparatus using a coin and a method of controlling the same is disclosed in Korean Patent Registration No. 09109630.

Since conventional coin counting apparatuses having the above-described structures tend not to detect coins according to materials of the coins passing through coin transfer channels while sorting the coins, reliability of detection and coin counting cannot be improved.

Technical Problem

The present invention is directed to providing a coin counting apparatus capable of increasing coin counting efficiency by improving detection reliability according to a kind of coin which passes through a coin transfer channel.

Technical Solution

One aspect of the present invention provides a coin counting apparatus including: a frame in which an accommodation part in a circular shape is formed and a coin transfer channel in a curved shape connected to an outlet provided at a partition forming the accommodation part is formed; a rotating transfer plate rotatably mounted in the accommodation part of the frame and including coin-accommodation grooves on a top surface thereof to transfer a coin, which is input, toward the outlet using rotational power of the coin; a coin-discharging roller unit configured to push the coin transferred and discharged toward the outlet using rotational power of the coin to pass the coin through a counter sensing unit mounted on the coin transfer channel at a predetermined speed; and a coin detection unit including a light irradiation unit configured to emit a plurality of beams toward the coin transfer channel in a normal or inclined direction with respect to a direction of a channel and an optical detection unit configured to detect beams reflected by coins to count the coins when the coins pass through the coin transfer channel The light irradiation unit may include a light irradiation slot formed in an inclined or normal direction with respect to a direction of transfer of the coin transfer channel, an optical fiber installed under the coin transfer channel in which the light irradiation slit is formed to emit a beam and including optical branching parts formed by forming notches in a predetermined pitch in a longitudinal direction, a light source coupled to one side of the optical fiber to emit a beam, and a housing which fixes the light source and the optical fiber. The optical detection unit may include an optical sensor configured to detect a beam emitted by the optical branching part of the optical fiber and reflected by the coin which moves over the beam irradiation slit.

Advantageous Effects

A coin counting apparatus according to the present invention can fundamentally prevent trouble which may occur when coins are moved while being counted, and furthermore can improve coin counting reliability.

MODES OF THE INVENTION

Figure 1:
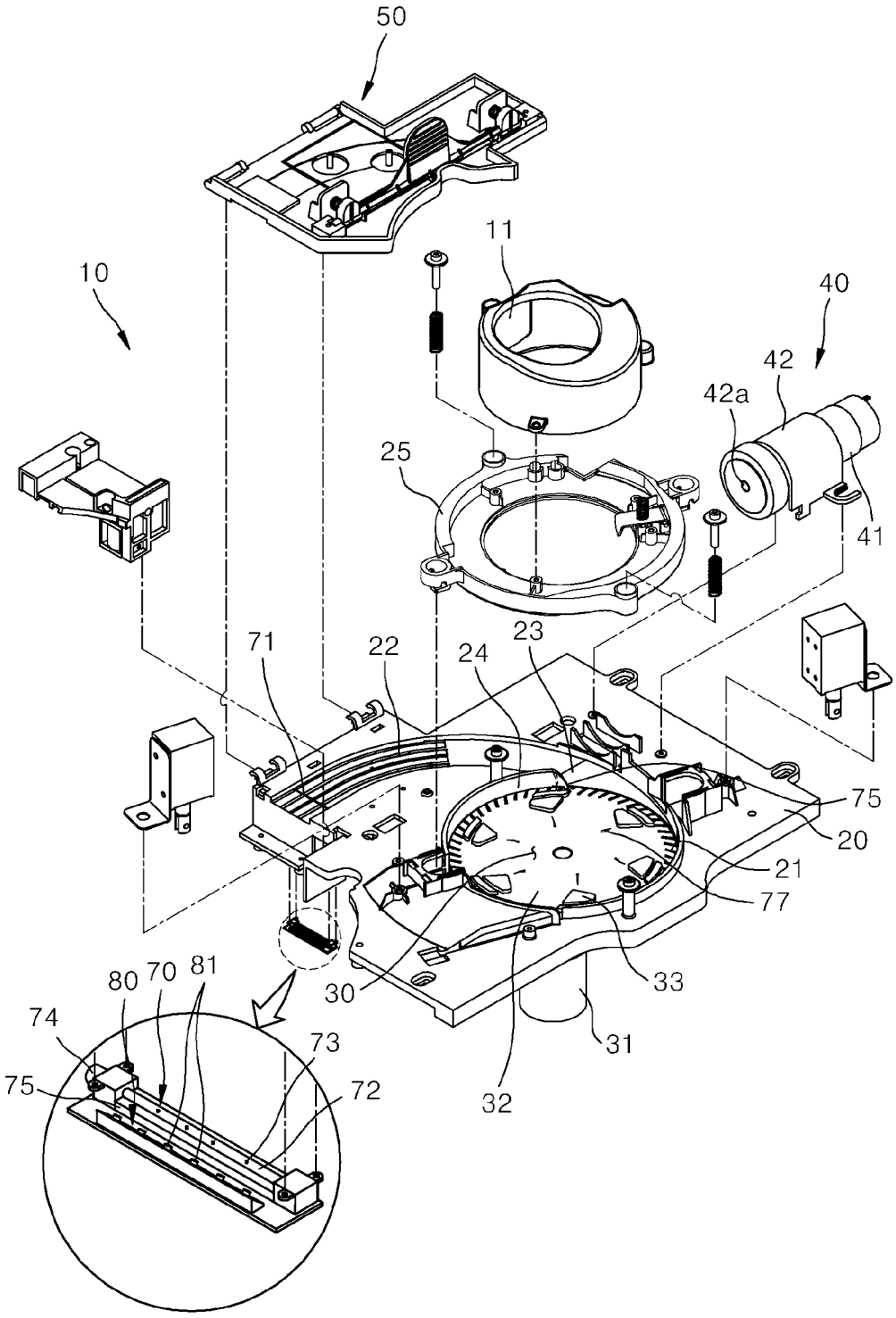
FIG. 1 is an exploded perspective view illustrating a coin counting apparatus according to the present invention
Figure 2:
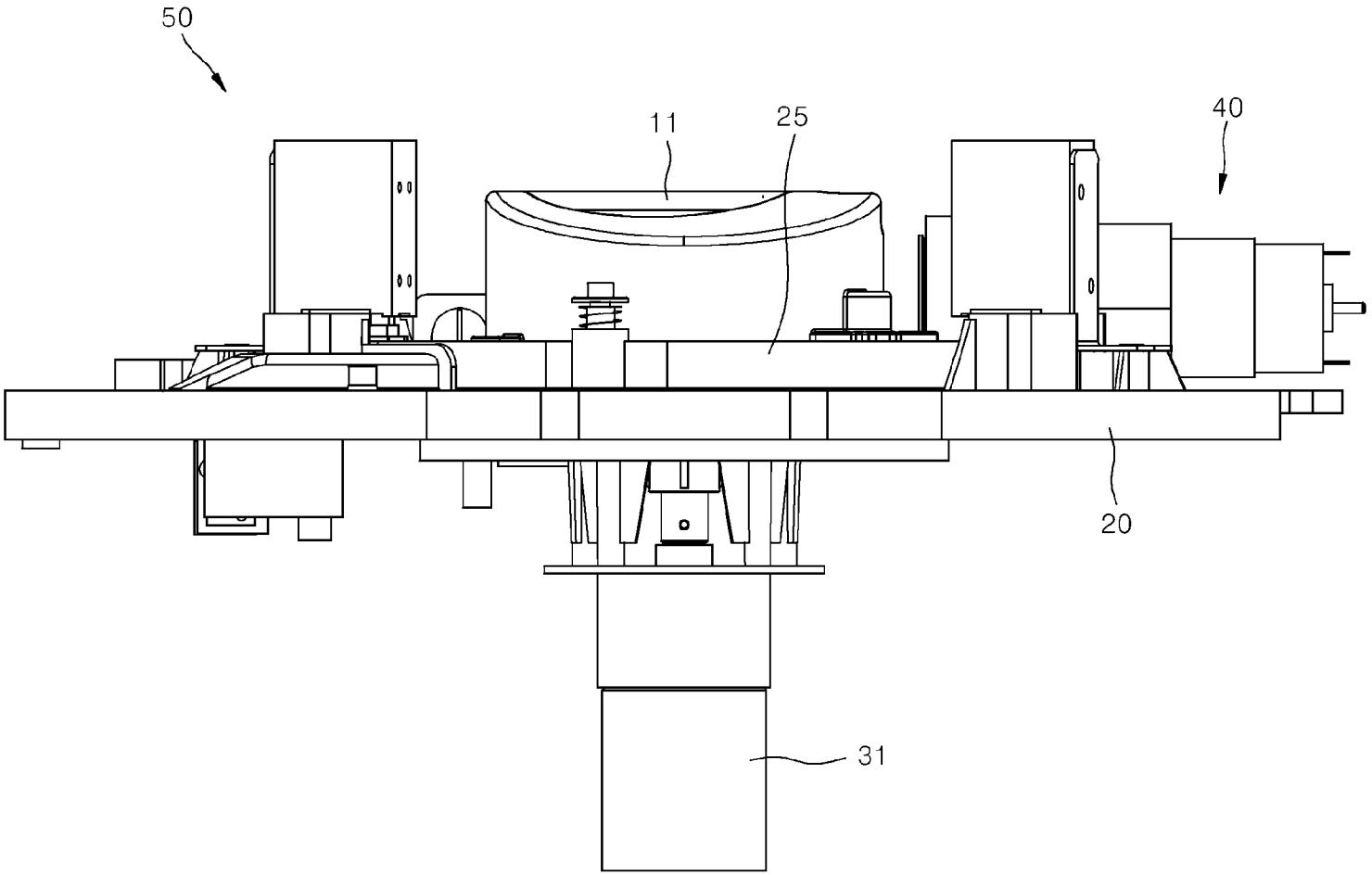
FIG. 2 is a side view illustrating the coin counting apparatus according to the present invention.
Figure 3:
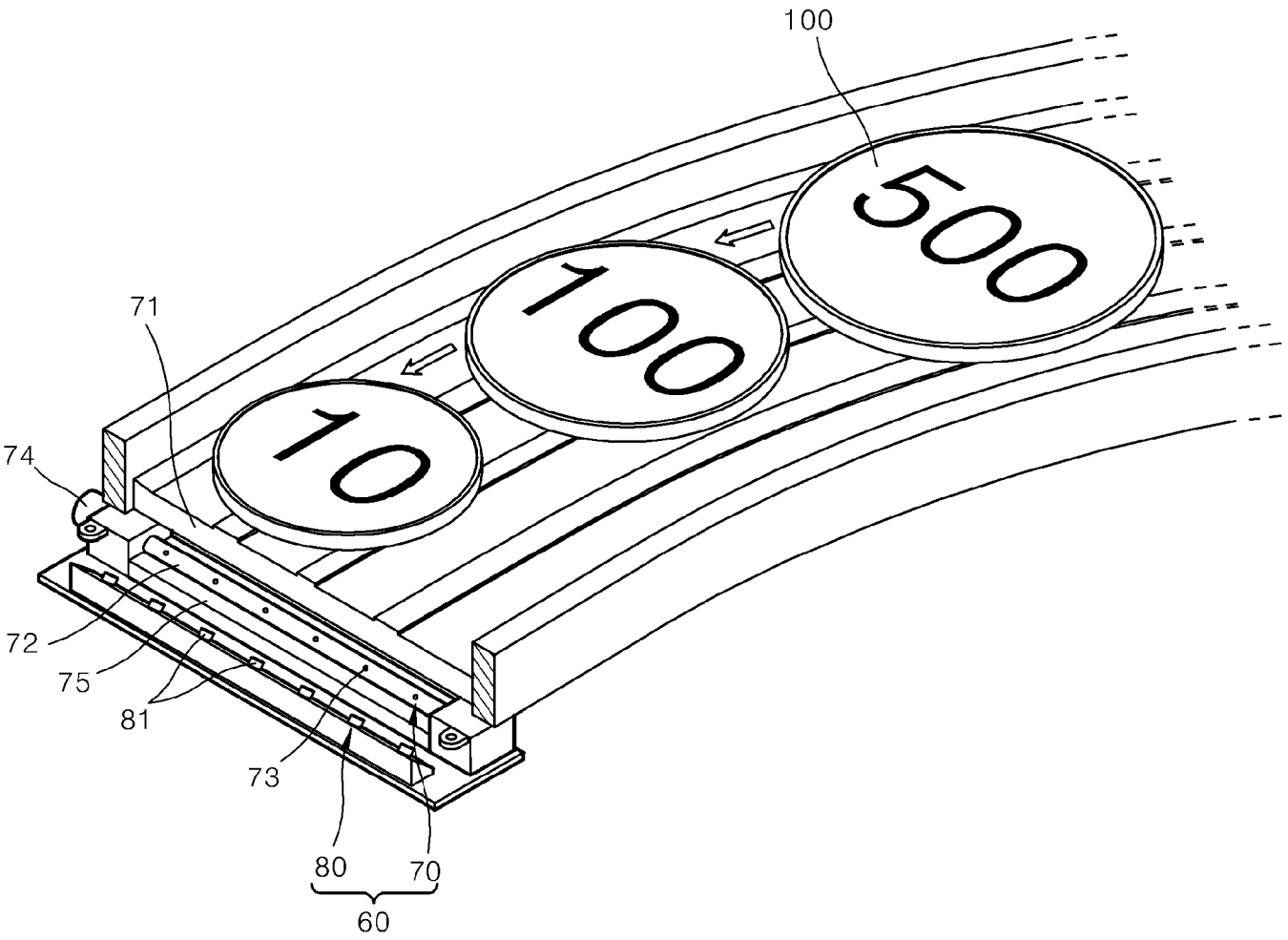
FIG. 3 is a partial cut perspective view illustrating a state in which a coin detection unit is installed in a coin transfer channel.

One embodiment of a coin counting apparatus according to the present invention, in which a unit of detecting coins discharged through a coin transfer channel is improved to count coins, is illustrated in FIGS. 1 to 3.

Referring to the drawings, a coin counting apparatus 10 according to the present invention includes a circular accommodation part 21 having a predetermined diameter, and a frame 20 on which a coin transfer channel 22 which communicates with the accommodation part 21 is formed. An outlet 23 is formed at one side of a partition forming the accommodation part 21 and the coin transfer channel 22 is connected to the accommodation part 21. The coin transfer channel 22 is formed in a predetermined curved shape extending from the accommodation part 21, and the coin transfer channel may be formed along a trajectory of an involute curved or scroll shape.

In addition, a rotating transfer plate 30 is rotatably installed in the accommodation part 21 of the frame 20 to be rotatable by a driving motor 31 installed under the frame 20, and comparting protrusions 33 which compart coin-accommodation grooves 32 are formed at an edge of a top surface of the rotating transfer plate 30. A height of the computing protrusions 33 is substantially the same as that of a coin. In addition, each of the coin-accommodation grooves 32 preferably has a diameter that is less than a sum of two diameters of a smallest coin used so that two coins are not simultaneously accommodated.

In addition, an exit of the coin-accommodation groove 32 formed on the top surface of the rotating transfer plate 30 is formed wider than an entrance thereof, and when a coin accommodated in the coin-accommodation groove 32 is positioned at a side of the outlet 23 due to rotation of the rotating transfer plate 30, the coin is discharged toward the outlet 23 due to centrifugal force. More specifically, a side of the outlet of the coin-accommodation groove 32, that is an edge of the rotating transfer plate 30, is sealed by an inner wall of the accommodation part 21 and the comparting protrusions, but since the outlet 23 is formed by cutting a sidewall forming the accommodation part of the frame 20, a lower portion of the coin-accommodation groove 32 maintains an open state when the coin-accommodation groove 21 is positioned at the side of the outlet 23.

In addition, a coin-discharging roller unit 40, configured to push a coin transferred and discharged toward the outlet 23 using rotational power to quickly pass a coin 100 through a counter sensing unit 50 at a predetermined speed and to allow the coin to be detected, is installed adjacent to the coin transfer channel 22 on the frame 20. The coin-discharging roller unit 40 includes a motor 41 installed on the frame 20 and a rotating roller 42 installed at a rotational shaft 42*a* of the motor 41.

The coin-discharging roller unit 40 is installed at a side of the outlet 23 of the frame 20 and pushes the coin discharged from the coin-accommodation groove 32 of the rotating transfer plate 30 again using the rotational power of the coin so that the coin quickly passes through the counter sensing unit 50 along the coin transfer channel 22 at the predetermined speed to be detected. That is, since the roller 42 of the coin-discharging roller unit 40 is positioned to be parallel to a surface of the outlet 23 and pushes the coin again using the rotational power of the coin when the coin is introduced therein, a counting time is effectively decreased. For example, when the coin 100 is transferred using only a rotational power of the rotating transfer plate 30 and passes through the counter sensing unit 50, a coin counting error may occur due to a speed deviation occurring according to a size and weight of the coin 100, but since the coin-discharging roller unit 50 pushes the coin, the coin counting error can be prevented.

In addition, although not illustrated in the drawings, a sensor configured to drive the driving motor 31 to rotate the rotating transfer plate 30 when the coin is input through the rotating transfer plate 30 and detect the coin may be installed in the accommodation part 21 of the frame 20. The sensor is preferably a proximity sensor but is not limited thereto. When the proximity sensor detects an input of a coin, a signal generated by the proximity sensor is identified by a controller (not shown), and the controller drives the driving motor 31 to rotate the rotating transfer plate 30 counter-clockwise (see FIG. 1). A forced return part (not shown) may also be installed on the frame 20 to return a bad coin or foreign material.

Meanwhile, the coin counting part 50 further includes a coin detection unit 60 having a light irradiation unit 70 configured to emit a plurality of beams toward the coin transfer channel 22 in a normal or inclined direction with respect to a direction of a channel and an optical detection unit 80 configured to detect reflected beams to count coins when the coins pass through the coin transfer channel 22.

Figure 4:
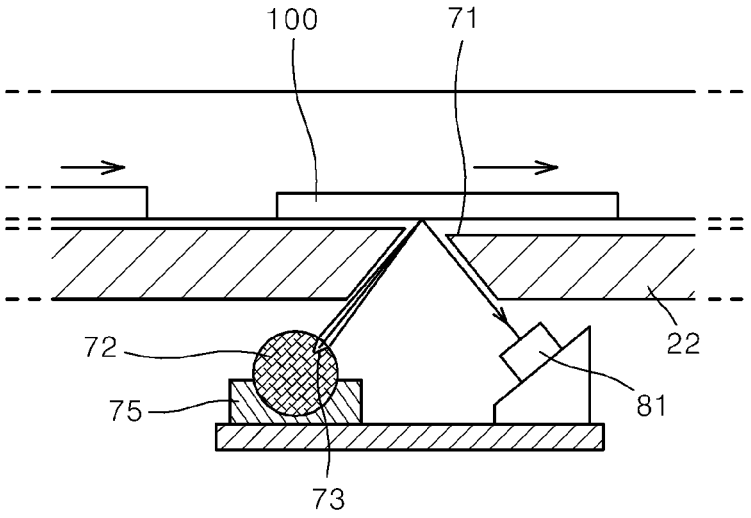
FIG. 4 is a side view illustrating an operational state of the coin detection unit according to the present invention.

As illustrated in FIGS. 1, 3, and 4, a light irradiation slot 71 is formed in the light irradiation unit 70 forming the coin detection unit 60 in a normal or inclined direction with respect to a transferring direction of the coin transfer channel 22, and an optical fiber 72 configured to vertically emit a plurality of beams upward through the light irradiation slot in a longitudinal direction of the light irradiation slot 71 is provided under the light irradiation slit 71 formed in the coin transfer channel 22. Optical branching parts 73 provided by forming notches having a predetermined pitch in a longitudinal direction are formed in the optical fiber 72, and the notches for the optical branching parts 73 are formed so that beams emitted from a light source which will be described below are branched and emitted. For example, the notches may have depths that gradually increase from the light source. In addition, a light source 74 configured to emit beams to the optical fiber 72 is provided at one side of the optical fiber 72, and the light source 74 may be formed with a light emitting diode but is not limited thereto.

The light source 74 is preferably formed at a side of the optical branching parts 73 formed at the optical fiber 72 rather than being formed to be vertical thereabove so that beams are reflected to have an inclined angle by a coin which moves over the light irradiation slot 71. As illustrated in FIGS. 1 and 3, the light source 74 and the optical fiber 72 may be supported the housing 75 and installed under the coin transfer channel 22.

The optical detection unit 80 detects beams branched by the optical branching parts 73 and reflected by coins passing above the light irradiation slit 71, and includes optical sensors 81 installed to correspond to the number of optical branching parts 73. Each of the optical sensors may be provided with a photodiode and the like. The optical sensors 81 are installed to correspond to the optical branching parts 73.

Meanwhile, a height of an upper edge of the light irradiation slit 71 is preferably greater than that of a lower edge thereof so that the coin 100 is not hindered by the light irradiation slit when the coin 100 moves through the coin transfer channel 22. In addition, the counter sensing unit 50 further includes a controller configured to count coins using signals detected by the coin detection unit 60.

Operational effects of the coin counting apparatus according to the present invention having the above structure will be described below with reference to the accompanying drawings.

First, when a user (a passenger) inputs coins of an appropriate fare into a coin input port 11 of the coin counting apparatus 10 installed in a public transportation system, coins 100 fall onto the rotating transfer plate 30 positioned under the coin input port 11. At this moment, when the input of the coins onto the rotating transfer plate 30 is detected by a proximity sensor installed in the accommodation part 21 of the frame 20, a controller (not shown) drives the driving motor 31 according to a detection signal of the proximity sensor to rotate the rotating transfer plate 30 in one direction and simultaneously drives the coin-discharging roller unit 40 to rotate the rotating roller 41 in one direction.

Accordingly, the coins on the rotating transfer plate 20 are pushed outward by centrifugal force to be accommodated in the coin-accommodation grooves 32 arranged at predetermined intervals and transferred to and sequentially discharged through the outlet 23.

The coins 100 discharged through the outlet 23 are transferred at a high predetermined speed by the coin-discharging roller unit 40 and pass through the counter sensing unit 50 along a curved portion of the coin transfer channel 22 in a state of being pressed against one sidewall thereof. The counter sensing unit 50 detects values of the coins, the controller aggregates the values of the coins detected by the counter sensing unit 50, and the aggregated values are displayed on a display (not shown). As a result, a driver of a public transportation system can easily determine whether money paid by the passenger is the appropriate fare.

As described above, since the coin detection unit 60 is installed in the coin transfer channel 22, reliability of counting the coins 100 can be further improved while counting the coins 100.

That is, when beams are emitted from the optical branching parts 73 of the optical fiber 72 forming the light irradiation unit 70 toward the light irradiation slit 71 formed in the coin transfer channel 22 and coins are transferred through the coin transfer channel 22, the beams are reflected by the coins 100, and the reflected beams are detected by the optical detection unit 80.

In such a process, the amount of light reflected by the optical branching parts 73 increases according to the size of the coin 100, and the amount of light detected by the optical detection unit increases. For example, since beams branched by two optical branching parts 73 are detected when a 10-won coin moves, beams branched by 3 or 4 optical branching parts 73 are detected when a 100-won coin moves, and beams branched by 5 or 6 optical branching parts 73 are detected when a 500-won coin moves, coins are accurately identified.

As described above, since the number of beams detected by the optical detection unit 70, that is the optical branching parts 63, varies according to sizes of coins, the controller can accurately count the coins using the number of beams counted by the coin counting part.

Accordingly, the coin counting apparatus can improve reliability of counting regardless of materials of coins.

Meanwhile, when bad coins or foreign materials (particularly, metallic screws, nails, nuts, and the like) are input onto the rotating transfer plate 30 with normal coins, the bad coins or foreign materials are returned by a forced return part which is not illustrated in the drawings.

As described above, since the coin counting apparatus according to the present invention quickly moves coins with predetermined intervals and accurately counts the coins, the coin counting apparatus can improve reliability of coin counting.

The present invention has been described with reference to the examples illustrated in the drawings, but these are only examples. Those skilled in the art should understand that various modifications and equivalent other examples may be made. Therefore, the scope of the present invention is defined by the appended claims. Therefore, the scope of the present invention is defined by the technological scope of the appended claims

INDUSTRIAL APPLICABILITY

A coin counting apparatus according to the present invention may be widely applied to a counting apparatus for chips similar to coins and the like as well as coins.

The invention claimed is:

1. A coin counting apparatus comprising:

a frame in which a circular accommodation part is formed and a coin transfer channel in a curved shape connected to an outlet provided at a partition forming the accommodation part is formed;

a rotating transfer plate rotatably mounted in the accommodation part of the frame and including coin-accommodation grooves on a top surface thereof to transfer a coin, which is input, toward the outlet using rotational power of the coin;

a coin-discharging roller unit configured to push the coin transferred and discharged toward the outlet using rotational power of the coin to pass the coin through a counter sensing unit mounted on the coin transfer channel at a predetermined speed; and a coin detection unit including a light irradiation unit configured to emit a plurality of beams toward the coin transfer channel in a normal or inclined direction with respect to a direction of a channel and an optical detection unit configured to detect beams reflected by coins to count the coins when the coins pass through the coin transfer channel;

wherein the light irradiation unit includes a light irradiation slit formed in an inclined or normal direction with respect to a direction of transfer of the coin transfer channel, an optical fiber installed under the coin transfer channel in which the light irradiation slit is formed to emit a beam and including optical branching parts formed by forming notches in a predetermined pitch in a longitudinal direction, a light source coupled to one side of the optical fiber to emit a beam, and a housing which fixes the light source and the optical fiber; and wherein the optical detection unit includes an optical sensor configured to detect a beam emitted by the optical branching part of the optical fiber and reflected by the coin which moves over the light irradiation slit.

2. A coin counting apparatus comprising:

a frame in which a circular accommodation part is formed and a coin transfer channel in a curved shape connected to an outlet provided at a partition forming the accommodation part is formed;

a rotating transfer plate rotatably mounted in the accommodation part of the frame and including coin-accommodation grooves on a top surface thereof to transfer a coin, which is input, toward the outlet using rotational power of the coin;

a coin-discharging roller unit configured to push the coin transferred and discharged toward the outlet using rotational power of the coin to pass the coin through a counter sensing unit mounted on the coin transfer channel at a predetermined speed; and a coin detection unit including a light irradiation unit configured to emit a plurality of beams toward the coin transfer channel in a normal or inclined direction with respect to a direction of a channel and an optical detection unit configured to detect beams reflected by coins to count the coins when the coins pass through the coin transfer channel;

wherein the light irradiation unit includes a light irradiation slit and a height of an upper edge of the light irradiation slit is greater than that of a lower edge thereof.

* * * * *